US005933988A

United States Patent [19]

Adler

[11] Patent Number: 5,933,988

[45] Date of Patent: Aug. 10, 1999

[54] IRONING MACHINE WITH HEATING CYLINDER AND CIRCULATION OF AIR

[75] Inventor: Michel Adler, Villery, France

[73] Assignee: Electrolux Systems De Blanchisserie, Rosieres Pres Troyes, France

[21] Appl. No.: 09/029,656

[22] PCT Filed: Jul. 7, 1997

[86] PCT No.: PCT/FR97/01221

§ 371 Date: Feb. 27, 1998

§ 102(e) Date: Feb. 27, 1998

[87] PCT Pub. No.: WO98/01612

PCT Pub. Date: Jan. 15, 1998

[30] Foreign Application Priority Data

Jul. 8, 1996 [FR] France ..... 96 08471

[51] Int. Cl.[6] ..... D06F 67/02; F28F 5/02

[52] U.S. Cl. ..... 38/44; 38/8; 38/66; 100/92; 492/12; 492/46

[58] Field of Search ..... 38/44, 1 C, 14, 38/8, 11, 1 R, 18, 52, 56, 66; 34/611, 151; 492/12, 20, 40, 46; 493/471; 100/38, 92, 24

[56] References Cited

U.S. PATENT DOCUMENTS

| | | | |
|---|---|---|---|
| 1,819,534 | 8/1931 | Akerlow . | |
| 1,950,669 | 3/1934 | Gleason | 492/46 X |
| 1,992,368 | 2/1935 | Geldhof | 38/14 X |
| 2,950,540 | 8/1960 | Fleissner | 38/14 X |
| 4,361,967 | 12/1982 | Bahnsen et al. | 34/20 X |
| 4,781,795 | 11/1988 | Miller | 100/92 X |
| 5,551,175 | 9/1996 | Neyman | 38/44 |

FOREIGN PATENT DOCUMENTS

| | | |
|---|---|---|
| 2652832 | 4/1991 | France . |
| 2698388 | 5/1994 | France . |

*Primary Examiner*—Ismael Izaguirre
*Attorney, Agent, or Firm*—Pearne, Gordon, McCoy & Grnager LLP

[57] ABSTRACT

In an ironing machine with a rotary ironing cylinder (14) comprising heating means (42) housed in an intermediary space (40) between the cylinder (14) and a fixed internal tube (34), air circulation is ensured inside the cylinder. Two ventilators (62, 68) take the air from regions at the ends of the space (40) via aspiration apertures (46, 48) and deliver it to a central area of the space via expressing apertures (50, 52).

11 Claims, 2 Drawing Sheets

FIG. 2

IRONING MACHINE WITH HEATING CYLINDER AND CIRCULATION OF AIR

DESCRIPTION

1. Field of the Invention

The invention relates to an ironing machine comprising a rotating ironing cylinder, a coaxially-fastened tube inside the cylinder, heating means disposed between the cylinder and the tube, and means for ensuring circulation of air in a closed circuit inside the cylinder.

The ironing machine of the invention may be used in all situations where relatively large quantities of flat laundry such as sheets, table cloths, towels, etc. need to be ironed frequently. The principal types of establishment for which the invention is designed include hospitals, guest houses, hotels, restaurants, etc.

2. Background Art

In ironing machines using a rotary, heating cylinder the laundry to be ironed is introduced between the cylinder and endless belts applied to the cylinder over most of its circumference. The endless belts are driven forward, causing the ironing cylinder to rotate. The ironing operation is ensured by compressing the laundry between the cylinder and the endless belts and by heating the cylinder.

In this type of machine the maximum width of the laundry that can be ironed is limited by the length of the cylinder. In practice, the widest items to be ironed are always narrower than this maximum width. This means that for a given item of laundry, only part of the cylinder is in contact with the item as it is ironed. Given that the entire length of the ironing cylinder is normally heated uniformly, the temperature of the area of the cylinder that is unused during ironing tends to rise above that of the area used for ironing.

In order to limit the consequences of this effect, makers of this type of ironing machine recommend that users insert items of laundry from each side of the cylinder alternately. However, it is virtually impossible to ensure that this recommendation is followed. Moreover, even when it is strictly followed it cannot totally prevent the creation of overheated areas on the cylinder. Once the machine has been used for a certain time this may even cause burning of ironed laundry.

To overcome this drawback, FR-A-2 652 832 discloses an invention whereby the ironing cylinder is heated internally using heating means such as reduced-length electrical resistors disposed over the entire length of the cylinder. Said heating means are controlled so that the temperature remains more or less uniform over the entire length of the cylinder during ironing.

This type of design satisfactorily solves the problem of localized overheating of the ironing cylinder. However, it has the drawback of being relatively complex and costly, which limits its use to top-of-the-range machines.

FR-A-2 698 388 discloses an invention whereby the problem of localized overheating of the ironing cylinder is solved by circulating air inside the cylinder. More precisely, a radial turbine is fitted to one end of a fixed tube disposed inside the cylinder and openings are formed in the other end of said tube. Air is thus caused to circulate axially in one direction inside the fixed tube and in the opposite direction in the intervening space between the cylinder and the tube.

This type of machine is less costly than that disclosed in FR-A-2 652 832. However, the principle of circulating air to ensure a uniform temperature over the entire length of the cylinder proves inefficient in practice. This inefficiency is particularly due to the fact that the air inside the cylinder is circulated from one end to the other, whereas the highest heat consumption is usually located in the central section of the cylinder irrespective of how the laundry is inserted into the machine. Also, the use of a radial turbine to move the air creates a relatively weak air flow that is insufficient to ensure effective transfer of heat inside the cylinder.

DISCLOSURE OF THE INVENTION

The present invention relates precisely to an ironing machine in which the interior of the ironing cylinder is fitted with means for circulating air at a cost comparable with the air circulating means equipping the machine disclosed in FR-A-2 698 388 but whose design makes it possible to transfer heat to where it is required.

According to the invention this result is obtained by means of an ironing machine comprising a rotary ironing cylinder, a fixed tube disposed coaxially inside the cylinder, heating means housed in an intermediary space between the cylinder and the tube, and means for circulating air ensuring air circulation in a closed circuit inside the cylinder, characterized by the fact that the air circulation means are arranged to aspirate the air in two areas at the ends of said space and express it in a central area of said space.

By taking air from areas at the ends of the space between the cylinder and tube and expelling it in the central area of the space the machine's air circulation means take the heat from where it is excessive and deliver it to where it is lacking. The temperature of the ironing cylinder is thereby made relatively uniform over its entire length, irrespective of the manner in which items of laundry are introduced into the machine. Any risk of accidental burning due to the presence of hot spots on the ironing cylinder is thereby avoided without using costly technology.

In a preferred embodiment of the invention the air circulation means comprise two series of aspiration apertures formed in the fixed tube facing the two ends of the said space, expressing apertures formed in the fixed tube facing the central area of the said space, and ventilation means placed inside the fixed tube between each series of aspiration apertures and expressing apertures.

The inside of the fixed tube is advantageously divided into two distinct areas separated by a median divider placed more or less perpendicularly to the axis of the tube. Each of these areas houses one of the ventilation means and communicating with the intermediate space via one of the series of aspiration apertures and a series of expressing apertures.

The heating means are normally electrical resistors oriented more or less along the axis of the tube. In this configuration the aspiration and expressing apertures in the fixed tube are formed more or less facing these resistors.

The aspiration and expressing apertures may be fitted with tongues stamped out of the metal of which the fixed tube is made and bent towards the interior of the tube. In this case the tongues in the various areas may be bent to a greater or lesser degree to adjust them to suit the conditions of use of the machine.

More generally, means for adjusting the dimensions of the aspiration and expressing apertures may be provided. Thus, and solely as a non-limiting example, the apertures may be composed of sash-type windows housed in frames capable of being axially displaced along the tube when the user pulls on devices provided for this purpose.

In order to control the air circulation means automatically, the machine of the invention is advantageously equipped with temperature detection means located outside the ironing cylinder facing the ends of the said space. The ventilation means are thus controlled by the temperature detection means to which they are connected.

Each ventilation means may therefore be activated when the temperature detected by the temperature detection means nearest the ventilation means exceeds a given upper threshold and stopped when the temperature drops below a given lower threshold.

In order to provide a relatively high flow of air inside the ironing cylinder, each ventilation means may consist of a ventilator or axial circulating pump.

In an improvement to the invention, the flow rate provided by each ventilator may be varied according to the temperature in the nearest end area either by modifying the rotation speed of the ventilator or by modifying the pitch angle of its blades.

BRIEF DESCRIPTION OF THE DRAWINGS

A preferred embodiment is now described. The description is given as a non-limitative example and refers to the attached Figures where.

DETAILED DESCRIPTION OF AN EMBODIMENT

Figure 1:
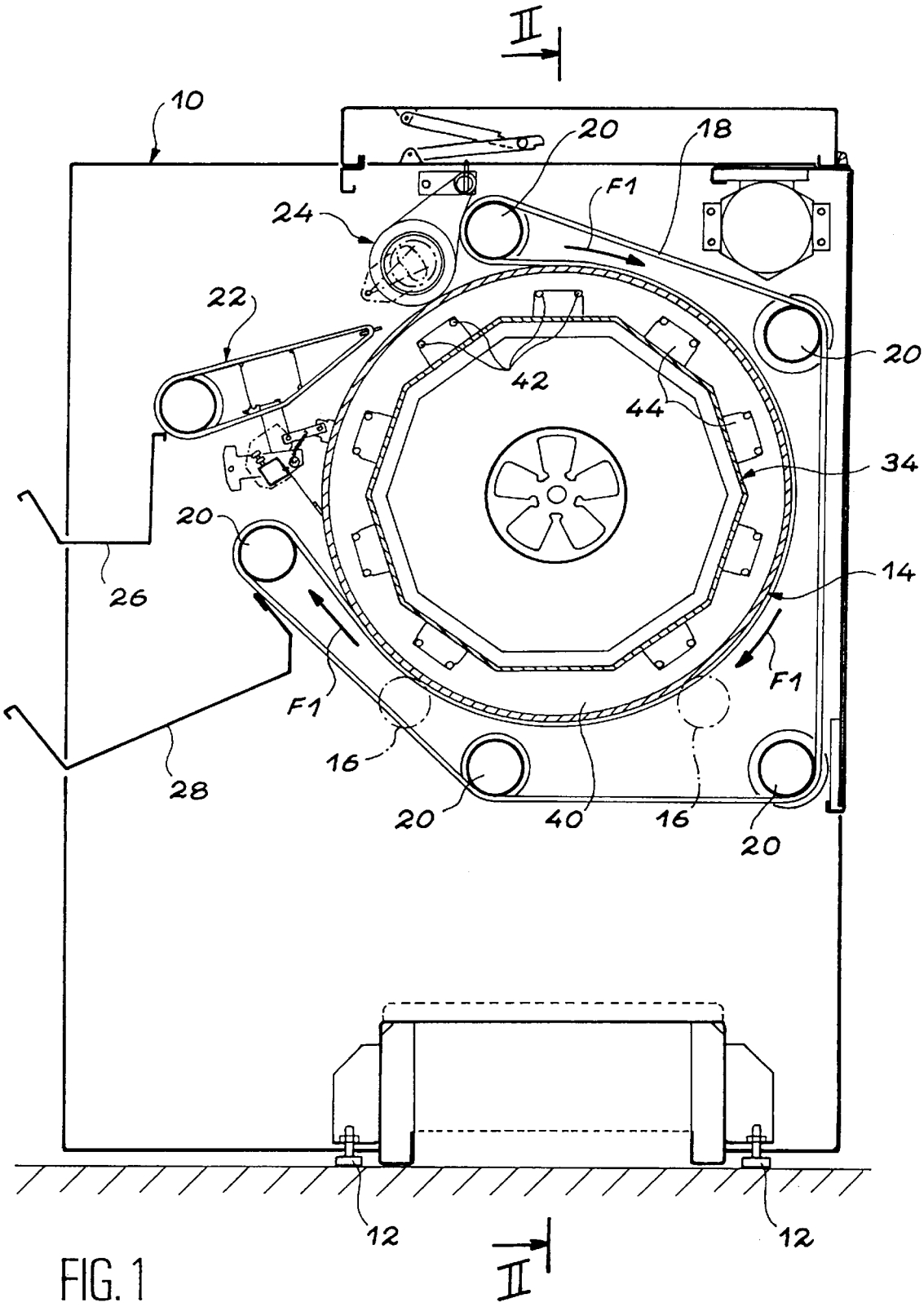
FIG. 1 is a diagrammatic transverse cross section of an ironing machine according to the invention.

In FIG. 1 the streamlined chassis of an ironing machine according to the invention is generally numbered 10.

Chassis 10, which is designed to rest on the ground on four feet 12, supports an ironing cylinder 14 that rotates around a horizontal axis. More precisely, ironing cylinder 14 rests on two rollers 16 mounted on parallel horizontal axles supported by chassis 10 so that they rotate freely on these axles. Ironing cylinder 14 is a hollow metal cylinder constructed, for example, of a piece of sheet metal shaped and closed upon itself.

Three quarters of the circumference of the entire length of ironing cylinder 14 is in contact with one or more endless belts 18 mounted on chassis 10 outside ironing cylinder 14. More precisely, the endless belts 18 are supported and guided by a series of rollers 20 whose parallel horizontal axles are supported by chassis 10. More precisely, the axles of rollers 20 are parallel to the axles of rollers 16. In addition, one of the rollers 20 is fitted with means for stretching the endless belts 18 while another roller 20 is motorized and capable of causing rotation by means of a geared motor (not shown).

When the motorized roller is rotated it drawn endless belts 18 with it in the direction shown by arrows F1 in FIG. 1. Because endless belts 18 are in contact with a large part of the circumference of ironing cylinder 14, movement of endless belts 18 in the direction shown by arrows F1 causes the ironing cylinder 14 to rotate in the same direction and at the same speed.

Items of laundry are ironed by introducing them into the upper part of the machine between ironing cylinder 14 and endless belts 18. For this purpose the user is provided with a laundry feed table 22 whose slightly sloping upper surface is set at an angle more or less tangential to the upper section of ironing cylinder 14 in the contact area between the cylinder and the endless belts 18.

A pressure roller 24 is normally fitted between laundry feed table 22 and the start of the contact area between the endless belts 18 and the cylinder 14 in order to facilitate introduction of items of laundry by pressing them against the cylinder.

As can be seen in FIG. 1, a laundry trough 26 may also be fitted to the inlet of laundry feed table 22 to receive the laundry for ironing.

At the other end of the contact area between the endless belts 18 and ironing cylinder 14 the chassis 10 of the machine supports another laundry trough 28 into which ironed laundry automatically falls.

Figure 2:
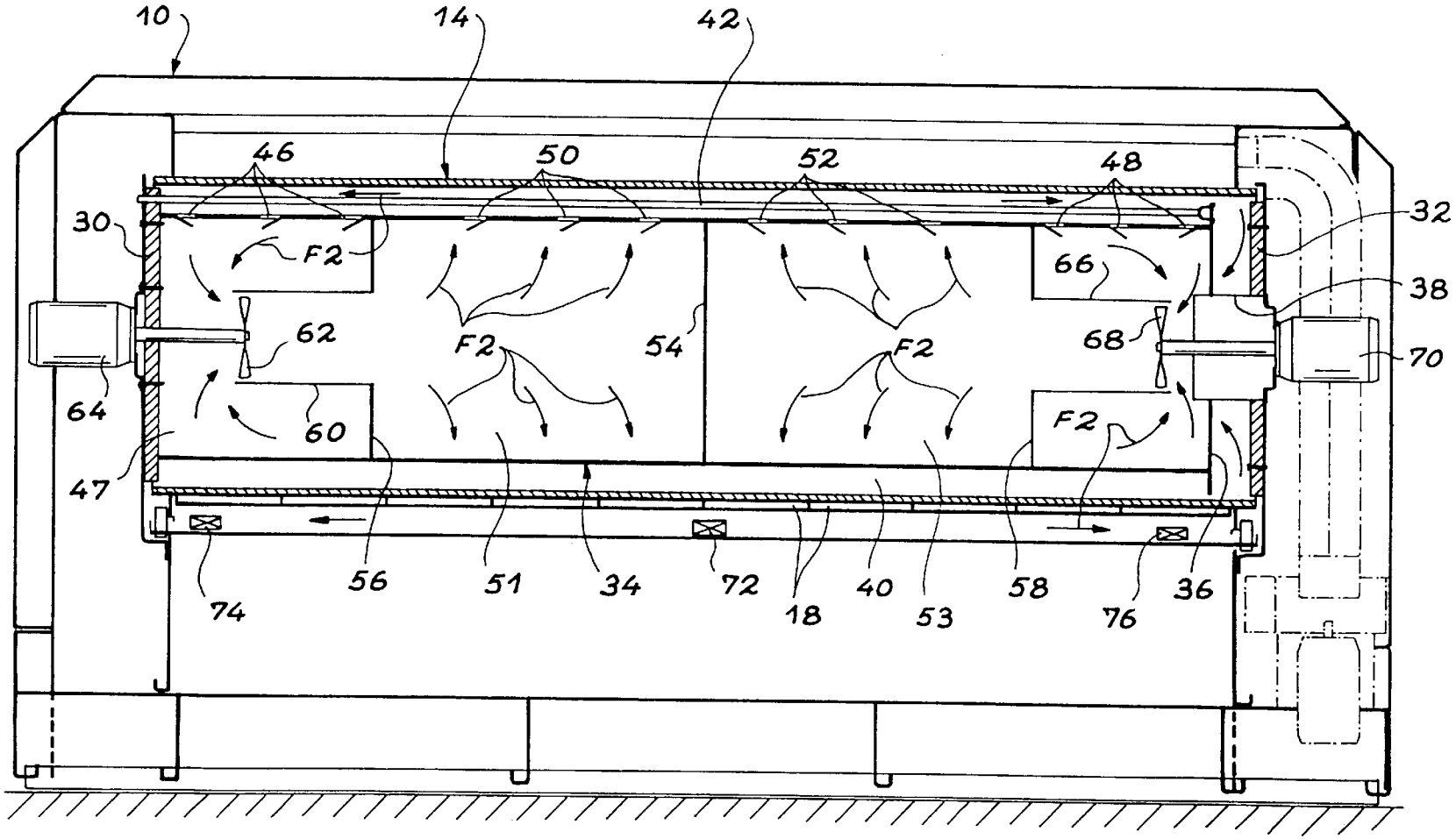
FIG. 2 is a longitudinal cross section along line II—II of FIG. 1.

As can be seen in FIG. 2, chassis 10 of the ironing machine of the invention supports two fixed disks 30 and 32 that each close one end of ironing cylinder 14.

A fixed tube 34 is fitted coaxially inside ironing cylinder 14. More precisely, a first end of fixed tube 34 is fastened to fixed disk 30 and its opposite end is supported by fixed disk 32. This is achieved by fastening the end of fixed tube 34 adjacent to fixed disk 32 to a mounting flange 36 capable of turning on a ferrule 38 fastened to disk 32. This arrangement allows for differential dilation between fixed tube 34 and chassis 10 of the machine.

As is shown more precisely in FIG. 1, fixed tube 34 is a metal tube whose cross-section is a regular polygon. In the embodiment shown the polygon has 10 sides.

Ironing cylinder 14 and fixed tube 34 form an intermediary annular space 40 in which are fitted the heating means consisting of electrical resistors 42. These electrical resistors 42 are very long and oriented parallel to the common axis of ironing cylinder 14 and fixed tube 34 whose ends are fastened to fixed disk 30 and flange 36 respectively.

As FIG. 1 shows, heating resistors 42 are fitted facing each side of the polygon formed in cross-section by fixed tube 34. No electrical resistor is fitted facing the bottom side of said polygon. Regularly distributed supports 44 connect each electrical resistor 42 to fixed tube 34 between disk 30 and flange 36.

In accordance with the invention, air circulation means are fitted inside ironing cylinder 14 so that they take air from the end areas of intermediary space 40 and convey it to the central area of said space. This air circulation cools the ends of the cylinder and conveys the heat to the central area of the cylinder. This helps to give a uniform temperature over the entire length of the cylinder since the ends of the cylinder come into contact with fewer items of laundry that the central area during operation of the machine. The creation of hot spots likely to burn the laundry is thereby avoided.

More precisely, the air circulation means comprise two series of aspiration apertures 46 and 48 formed in the fixed tube 34 facing the end areas of intermediary space 40 from which air is to be taken. As can be seen in FIG. 2, some of the aspiration apertures 48 may be formed in flange 36 fastened to the end of tube 34.

The air circulation means also comprise two series of expressing apertures 50 and 52 formed in fixed tube 34 facing the central area of intermediary space 40 that is to be heated. More precisely, the two series of expressing apertures 50 and 52 are formed in fixed tube 34 on either side of a median divider 54 that divides the space inside fixed tube 34 into two more or less equal volumes. Median divider 54 is fitted more or less perpendicular to the axis of tube 34 and equidistant from disk 30 and flange 36.

Each of the two volumes thereby created by median divider 54 inside fixed tube 34 is itself divided into two chambers by dividers 56 and 58 parallel to said median divider. Dividers 56 and 58 are placed between aspiration apertures 46 and expressing apertures 50, and between aspiration apertures 48 and expressing apertures 52 respectively. The chambers located facing aspiration apertures 46 and 48 are numbered 47 and 49 respectively and the chambers located facing expressing apertures 50 and 52 are numbered 51 and 53 respectively.

The central section of divider 56 is extended towards fixed disk 30 by a cylindrical tunnel 60 of which the section nearest disk 30 houses a ventilator or axial circulating pump 62 constituting a first ventilating means. Said ventilator 62, whose axis is the same as that of tube 34, is caused to rotate by an electric motor 64 mounted on disk 30 and located outside the space defined by ironing cylinder 14.

Similarly, the central section of divider 58 is extended towards flange 36 by a cylindrical tunnel 66 of which the section nearest flange 36 houses a ventilator or axial circulating pump 68 constituting a second ventilating means. Said ventilator 68, whose axis is the same as that of tube 34, is caused to rotate by an electric motor 70 mounted on disk 32 and located outside the space defined by ironing cylinder 14.

The arrangement described above enables the air contained in ironing cylinder 14 to be circulated in the direction shown by arrows F2 in FIG. 2 when ventilators 62 and 68 are activated. Thus the air contained in the two end areas of intermediary space 40, located facing the two series of aspiration apertures 46 and 48 is transferred by the two ventilators 62 and 68 into chambers 47 and 49 through the said aspiration apertures. Ventilators 62 and 68 then convey this air into chambers 51 and 53 from where it exits in the central area of intermediary space 40 through the two series of expressing apertures 50 and 52.

The air circulation caused by ventilators 62 and 68 ensures a relatively high air flow that eliminates any hot spots on the ironing cylinder irrespective of how the user inserts items of laundry.

If required, the air flow may be varied. This may be done either by varying the pitch angle of the blades of ventilators 62 and 68 or by modifying the rotation speed of the ventilators by adjusting electric motors 64 and 70.

The positioning of dividers 56 and 58 is such that, when relatively broad items of laundry such as sheets are introduced on alternate sides of the ironing cylinder, approximately one third of the width of the items of laundry are alternately positioned facing aspiration apertures 46 or 48. The presence of tunnels 60 and 66 housing ventilators 62 and 68 make it possible to reduce as much as possible any protrusion of the axles bearing said ventilators.

In order to increase the efficiency of the air circulation means of the invention, aspiration apertures 46 and 48 and expressing apertures 50 and 52 are located in fixed tube 34 more or less facing electrical resistors 42, i.e. in the central area of each side of the regular polygon formed in cross-section by fixed tube 34. No electrical resistor is fitted to the bottom side of said polygon.

In the embodiment shown in very diagrammatic form in FIG. 2, apertures 46, 48, 50 and 58 are stamped out of the sheet metal used to make fixed tube 34. More precisely, these apertures comprise tongues stamped out of the metal of which the fixed tube is made and bent towards the interior of fixed tube 34 in whichever direction best facilitates circulation of the air. This arrangement makes it possible, if necessary, to adjust the size of the apertures by opening the tongues more or less depending on where they are located. The machine may therefore be customized simply and cheaply.

In a variant embodiment (not shown) the dimensions of aspiration apertures 46 and 48 and expressing apertures 50 and 52 may be adjusted using adjustment means accessible, for example, via the surface of disk 30 that faces the outside of ironing cylinder 14. In practice, these apertures may comprise a fixed section cut directly into tube 34 and a section that moves parallel to the axis of said tube. The apertures can thereby be made more or less open by axially displacing the movable sections along the lines of sash-type windows. The movable sections, that may, for example, be grouped on frames common to each series of apertures, may thus be displaced by means of devices that pass through disk 30 and terminate in adjusting handles.

In order to ensure automatic operation of electrical heating resistors 42 and the air circulation means described above, the machine advantageously comprises temperature detection means for controlling the temperature along the entire length of ironing cylinder 14.

In the embodiment shown in FIG. 2, said temperature detection means comprise three temperature sensors 72, 74 and 76, fitted to chassis 10 on the outside of ironing cylinder 14 in the immediate proximity of the cylinder 14. Sensor 72 is fitted facing the central area of the cylinder while sensors 74 and 76 are fitted facing each end of the cylinder.

Central sensor 72 is used to control the starting and stopping of the heating means composed of electrical resistors 42. More precisely, sensor 72 shuts down the heating when the temperature detected exceeds a given upper threshold and starts up the heating when the temperature drops below a given lower threshold.

Temperature sensor 74 is used to start and stop ventilator 62 in front of which it is placed. More precisely, temperature sensor 74 starts up electric motor 64 when the temperature detected exceeds a given upper threshold and shuts down the motor when the temperature drops below a given lower threshold.

Similarly, temperature sensor 76 is used to start and stop ventilator 68 in front of which it is placed. More precisely, temperature sensor 76 starts up electric motor 70 when the temperature detected exceeds a given upper threshold and shuts down the motor 70 when the temperature drops below a given lower threshold.

The upper and lower temperature thresholds detected by temperature sensors 74 and 76 are preferably identical.

In practice temperature sensors 72, 74 and 76 may be dual-contact thermostats. In a variant of the invention they may be sensors associated with an electronic circuit.

Although the machine according to the invention has been described in its preferred application for ironing laundry, it may also be used for dimensioning items of laundry by thermosetting or in the context of fixing textile colorant on textiles using thermofixing techniques.

I claim:

1. Ironing machine comprising a rotary ironing cylinder, a fixed tube disposed coaxially inside the cylinder, heating means housed inside an intermediary space between the cylinder and the tube, and air circulation means ensuring circulation of air in a closed circuit inside the cylinder, wherein the air circulation means are arranged to aspirate the air from two ends of said space and express it in the central region of said space.

2. Machine of claim 1, wherein said air circulation means comprise two series of aspiration apertures formed in fixed tube facing the two end areas of said space, expressing apertures formed in the fixed tube facing the central area of said intermediary space, and ventilation means placed inside the fixed tube between each series of aspiration apertures and expressing apertures.

3. Machine of claim 2, wherein an inside of the fixed tube is divided into two distinct areas separated by a median divider placed generally perpendicular to an axis of the tube, each of said two areas housing one of the ventilation means and communicating with said space via one of said two series of aspiration apertures and a series of expressing apertures.

4. Machine of claim 2, wherein said heating means are electrical resistors oriented generally along the axis of the fixed tube, and wherein the aspiration and expressing apertures in the fixed tube are generally facing said resistors.

5. Machine of claim 2, wherein the aspiration and expressing apertures comprise tongues stamped out of the fixed tube and bent towards the interior of the tube.

6. Machine of claim 2, further comprising means for adjusting the aspiration and expressing apertures.

7. Machine of claim 2, further comprising temperature detection means, said temperature detection means being located on an outside of the ironing cylinder facing the areas at the two ends of said space, and wherein the ventilation means are controlled by said temperature detection means.

8. Machine of claim 7, wherein each ventilation means is activated when the temperature detected by the temperature detection means nearest said ventilation means exceeds a given upper threshold and deactivated when the temperature drops detected by the temperature detection means nearest said ventilation means is below a given lower threshold.

9. Machine of claim 2 wherein each ventilation means comprises an axial ventilator.

10. Machine of claim 9, wherein said ventilators have variable rotation speeds.

11. Machine of claim 9, wherein the blades of ventilators have a variable pitch angle.

* * * * *